US008805269B2

(12) United States Patent
Aoyagi

(10) Patent No.: US 8,805,269 B2
(45) Date of Patent: Aug. 12, 2014

(54) SENSOR, CONVEYING DEVICE, AND IMAGE FORMING APPARATUS

(75) Inventor: Keiichi Aoyagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 356 days.

(21) Appl. No.: 13/044,088

(22) Filed: Mar. 9, 2011

(65) Prior Publication Data

US 2012/0076512 A1 Mar. 29, 2012

(30) Foreign Application Priority Data

Sep. 28, 2010 (JP) ..... 2010-217155

(51) Int. Cl.
*G03G 15/00* (2006.01)

(52) U.S. Cl.
USPC ..... 399/400; 250/227.22; 250/227.14; 250/227.29

(58) Field of Classification Search
USPC ..... 399/400; 250/227.22, 227.29, 227.14
See application file for complete search history.

(56) References Cited

U.S. PATENT DOCUMENTS

| | | | | | |
|---|---|---|---|---|---|
| 4,587,997 | A * | 5/1986 | Brooks | 139/420 R |
| 5,854,958 | A * | 12/1998 | Tanimoto et al. | 399/49 |
| 6,298,586 | B1 * | 10/2001 | Todome | 399/303 |
| 2004/0008245 | A1 * | 1/2004 | Hirai et al. | 347/129 |
| 2006/0104654 | A1 * | 5/2006 | Borton et al. | 399/74 |
| 2008/0279330 | A1 * | 11/2008 | Ueki | 378/63 |

FOREIGN PATENT DOCUMENTS

| | | | |
|---|---|---|---|
| JP | 56087803 | A * | 7/1981 |
| JP | 62-234173 | A | 10/1987 |
| JP | 09-146187 | A | 6/1997 |
| JP | 2002221609 | A * | 8/2002 |
| JP | 2008063701 | A * | 3/2008 |

* cited by examiner

*Primary Examiner* — Matthew G Marini
*Assistant Examiner* — Allister Primo
(74) *Attorney, Agent, or Firm* — Sughrue Mion, PLLC

(57) ABSTRACT

A sensor includes: a light emitting part that emits light; a light receiving part that receives reflected light, which is emitted from the light emitting part, is reflected, and returns; and plural arranged fiber bodies that are disposed on a front side of at least one of the light emitting part and the light receiving part and operate as a filter limiting an emission angle or a light receiving angle.

17 Claims, 5 Drawing Sheets

SENSOR, CONVEYING DEVICE, AND IMAGE FORMING APPARATUS

CROSS-REFERENCE TO RELATED APPLICATION

This application is based on and claims priority under 35 U.S.C. 119 from Japanese Patent Application No. 2010-217155 filed on Sep. 28, 2010.

BACKGROUND

1. Technical Field

The present invention relates to a sensor, a conveying device and an image forming apparatus.

2. Related Art

A plate-like or film-like optical filter has been known in the past.

When the presence or absence of a detection target is detected by a reflection-type light sensor, an optical filter causes condensation in certain temperatures and humidities of the surrounding environment if the optical filter is placed on the front side of a light emitting part or the light receiving part so that the presence of the detection target is not falsely detected by the light reflected and scattered by members or the like except for the detection target. For this reason, the optical filter may lose the function of a sensor.

SUMMARY

According to an aspect of the invention, there is provided a sensor including: a light emitting part that emits light; a light receiving part that receives reflected light, which is emitted from the light emitting part, is reflected, and returns; and plural arranged fiber bodies that are disposed on a front side of at least one of the light emitting part and the light receiving part and operate as a filter limiting an emission angle or a light receiving angle.

BRIEF DESCRIPTION OF THE DRAWINGS

Exemplary embodiments of the present invention will be described in detail based on the following figures, wherein.

DETAILED DESCRIPTION

An exemplary embodiment of the invention will be described below.

Figure 1:
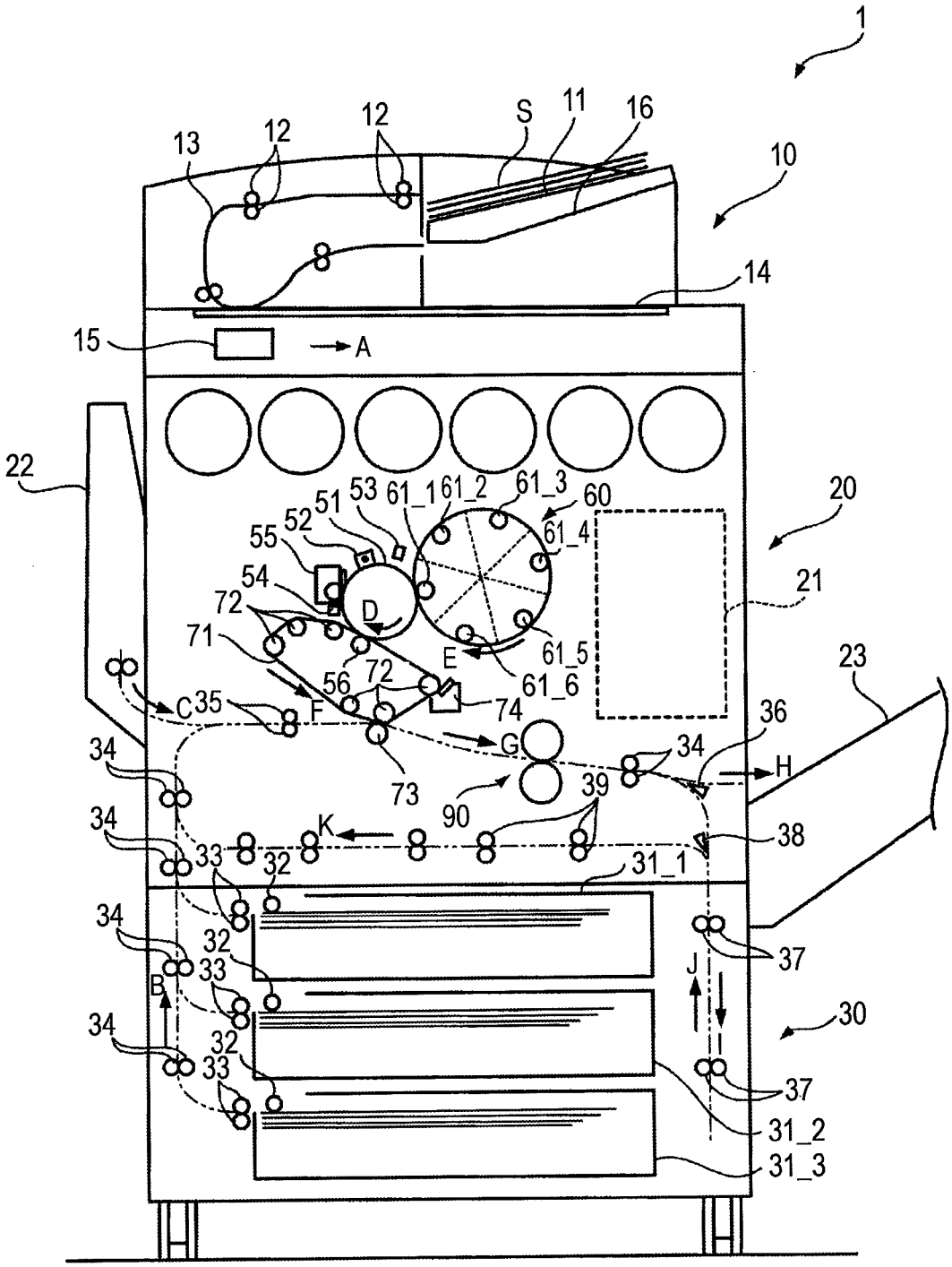
FIG. 1 is a schematic view showing the configuration of an image forming apparatus according to an exemplary embodiment of the invention.

FIG. 1 is a schematic view showing the configuration of an image forming apparatus according to an exemplary embodiment of the invention. The image forming apparatus shown in FIG. 1 is provided with a sensor according to an exemplary embodiment of the invention and a conveying device according to an exemplary embodiment of the invention.

An image forming apparatus 1 includes a document reading section 10, an image forming section 20, and a sheet storage section 30.

The document reading section 10 is provided with a document feed tray 11 on which documents S are placed while being stacked. The documents S placed on the document feed tray 11 are sent one by one and are conveyed on a conveying path 13 by conveying rollers 12. Characters or images recorded on the conveyed document are read out by a document reading optical system 15 that is disposed below a document reading plate 14 made of transparent glass, and the document is ejected onto a document ejection tray 16.

Further, the document reading section 10 includes a hinge of which a rear portion extends in a lateral direction, and the document feed tray 11 and the document ejection tray 16 can be lifted as a single body while being rotated about the hinge as a rotation center. The document reading plate 14 spreads below the document feed tray 11 and the document ejection tray 16 that are lifted. In the document reading section 10, documents are not placed on the document feed tray 11, only one document is placed on the document reading plate 14 so as to face the lower side, and the document reading optical system 15 moves in the direction of an arrow A, so that characters or images can be read out from the document placed on the document reading plate 14.

An image signal obtained by the document reading optical system is input to a processing/control circuit 21. The processing/control circuit 21 forms an image based on the input image signal as follows. Further, the processing/control circuit 21 controls the operation of each section of the image forming apparatus 1.

Furthermore, three sheet feed trays 31_1, 31_2, and 31_3 are received in the sheet storage section 30 that is provided at a lower portion of the image forming apparatus 1. For example, sheets P having different sizes are stored in the respective sheet feed trays 31_1, 31_2, and 31_3 while being stacked in these sheet feed trays 31_1, 31_2, and 31_3. Each of the sheet feed trays 31_1, 31_2, and 31_3 is adapted to be freely drawn for the supply of the sheets P.

Sheets P are sent from the sheet feed tray (which is the sheet feed tray 31_3 as an example here), in which sheets P having, for example, the size corresponding to the size of the document are stored, among these three sheet feed trays 31_1, 31_2, and 31_3, by a pick-up roller 32; and are separated one by one by separating rollers 33. Then, the separated one sheet P is conveyed upward in the direction of an arrow B by conveying rollers 34, and is further conveyed after a later conveying timing of the sheet is adjusted by standby rollers 35. The conveyance of the sheet behind the standby rollers 35 will be described below.

Further, the image forming section 20 is provided with a manual sheet feed tray 22. The manual sheet feed tray 22 is a folding tray that is opened so as to be rotated about a lower end portion thereof. If the manual sheet feed tray 22 is opened and sheets are placed on the manual sheet feed tray, the sheets placed on the manual sheet feed tray 22 can also be sent in the direction of an arrow C.

A photoconductor 51, which is rotated in the direction of an arrow D, is provided at a middle portion of the image forming section 20. A charger 52, an exposure unit 53, a developing device 60, a discharger 54, and a cleaner 55 are disposed around the photoconductor 51. Further, a transfer unit 56 is disposed at a position where an intermediate transfer belt 71 to be described below is interposed between the photoconductor 51 and the transfer unit.

The photoconductor 51 has the shape of a roller. The photoconductor 51 keeps electric charges by being charged and discharges the electric charges by being exposed to light, so that an electrostatic latent image is formed on a surface of the photoconductor.

The charger 52 charges the surface of the photoconductor 51 to a certain charge potential.

Further, an image signal is input to the exposure unit 53 from the processing/control circuit 21, and the exposure unit 53 outputs exposure light that is modulated according to the input image signal. After being charged by the charger 52, the photoconductor 51 is irradiated with the exposure light output from the exposure unit 53. Accordingly, an electrostatic latent image is formed on the surface of the photoconductor 51. Furthermore, after the photoconductor 51 is irradiated with exposure light and the electrostatic latent image is formed on the surface of the photoconductor 51, the electrostatic latent image is developed by the developing device 60. Accordingly, a toner image is formed on the surface of the photoconductor 51. Here, the developing device 60 includes six developing units 61_1, 61_2, 61_3, 61_4, 61_5, and 61_6. The developing device 60 is rotated in the direction of an arrow E, so that any one developing unit (which is the developing unit 61_1 in the state shown in FIG. 1) of the six developing units 61_1 to 61_6 is moved to a position facing to the photoconductor 51. The electrostatic latent image formed on the photoconductor 51 is developed by the developing unit (which is the developing unit 61_1) facing the photoconductor 51, so that the toner image is formed.

A yellow (Y) toner, a magenta (M) toner, a cyan (C) toner, and a black (K) toner, and two special color toners according to the intended purpose of a user are stored in the six developing units 61_1 to 61_6 of the developing device 60, respectively. When the electrostatic latent image formed on the photoconductor 51 is developed, a developing unit storing a color toner to be used at this time is moved to the position facing the photoconductor 51. Then, the development of the electrostatic latent image is performed with the color toner, which is stored in the developing unit facing the photoconductor 51, by the developing unit facing the photoconductor 51. For example, a transparent toner that is used to glaze an image, a toner of which the color is adjusted to a color frequently used by the user, or the like may be used as the special color toner according to the intended purpose of the user.

The toner image, which is formed on the photoconductor 51 through the development performed by the developing unit, is transferred to the intermediate transfer belt 71 by the operation of the transfer unit 56.

The photoconductor 51 is discharged after the transfer of the toner image by the discharger 54. Further, a toner remaining on the photoconductor 51 after the transfer of the toner image is removed by the cleaner 55.

The intermediate transfer belt 71 is an endless belt that is stretched by plural rollers 72 and rotated in the direction of an arrow F. A transfer unit 73 is disposed near the intermediate transfer belt 71 at a position where the conveying path of the sheet P is interposed between the intermediate transfer belt 71 and the transfer unit 73. Further, a cleaner 74, which removes the toners remaining on the intermediate transfer belt 71 after the toner images are transferred by the transfer unit 73, is disposed on the downstream side of the transfer unit 73 in the rotation direction of the intermediate transfer belt 71. The transfer unit 73 and the cleaner 74 are adapted so as to freely come into contact with and separate from the intermediate transfer belt 71. When images are to be formed using plural colors, the transfer unit 73 and the cleaner 74 separate from the intermediate transfer belt 71 and processes, which form a toner image on the photoconductor 51 by using a certain color toner and transfer the toner image to the intermediate transfer belt 71, are repeated in regard to the plural developing units (plural color toners) while the developing device 60 is rotated, and plural toner images formed using the plural color toners are transferred so as to be sequentially superimposed on the intermediate transfer belt 71.

After that, the transfer unit 73 comes into contact with the intermediate transfer belt 71; a sheet P is sent from the standby rollers 35 so that the sheet P reaches a transfer position where the transfer unit 73 is disposed when the superimposed plural color toner images reach the transfer position; and the plural color toner images formed on the intermediate transfer belt 71 are transferred to the sheet P at the transfer position by the operation of the transfer unit 73. The sheet to which the toner images have been transferred is further conveyed in the direction of an arrow G and is heated and pressed by a fixer 90, so that an image formed of the fixed toner images is formed on the sheet. The sheet having passed through the fixer 90 is further conveyed in the direction of an arrow H and is ejected onto a sheet ejection tray 23.

Further, the cleaner 74 is also moved so as to come into contact with the intermediate transfer belt 71, and the toners, which remain on the intermediate transfer belt 71 after the toner images are transferred by the transfer unit 73, are removed from the intermediate transfer belt 71 by the cleaner 74.

Meanwhile, the image forming apparatus 1 is an apparatus that can form images on both sides of a sheet P. When images are to be formed on both sides of a sheet P, a sheet P, where an image has been formed only on one side of the sheet P in the above-mentioned manner, is not ejected onto the sheet ejection tray 23 and conveyed in the direction of an arrow I by conveying rollers 37 through a switching of a guide member 36. After that, the conveying direction is reversed, the sheet P is conveyed at this time in the direction of an arrow K by another guide member 38, is conveyed by conveying rollers 39, and reaches the standby rollers 35.

Subsequently, an image is formed on the other side of the sheet P at this time in the above-mentioned manner. The sheet P, where images have been formed on both sides in the above-mentioned manner, is ejected onto the sheet ejection tray 23 at this time.

Figure 2:
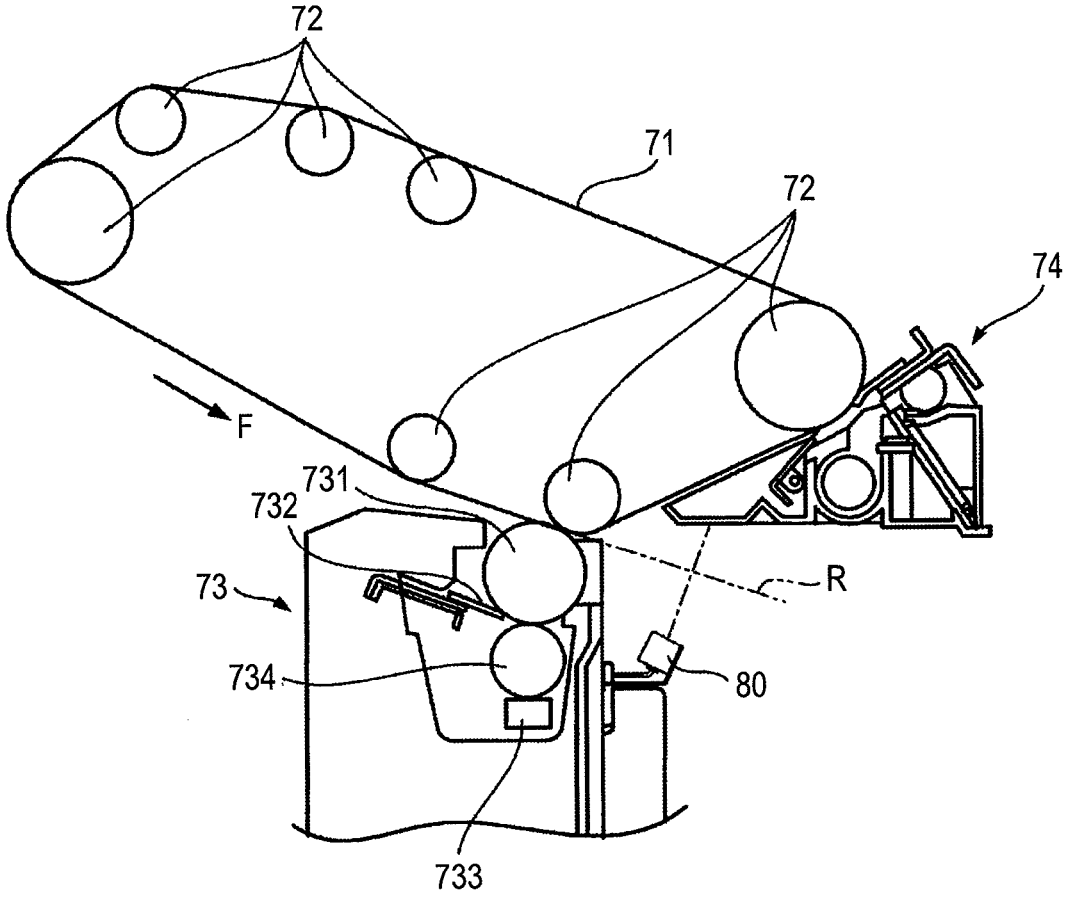
FIG. 2 is a schematic view showing an intermediate transfer belt, and a transfer unit and a cleaner that are disposed around the intermediate transfer belt.
Figure 3:
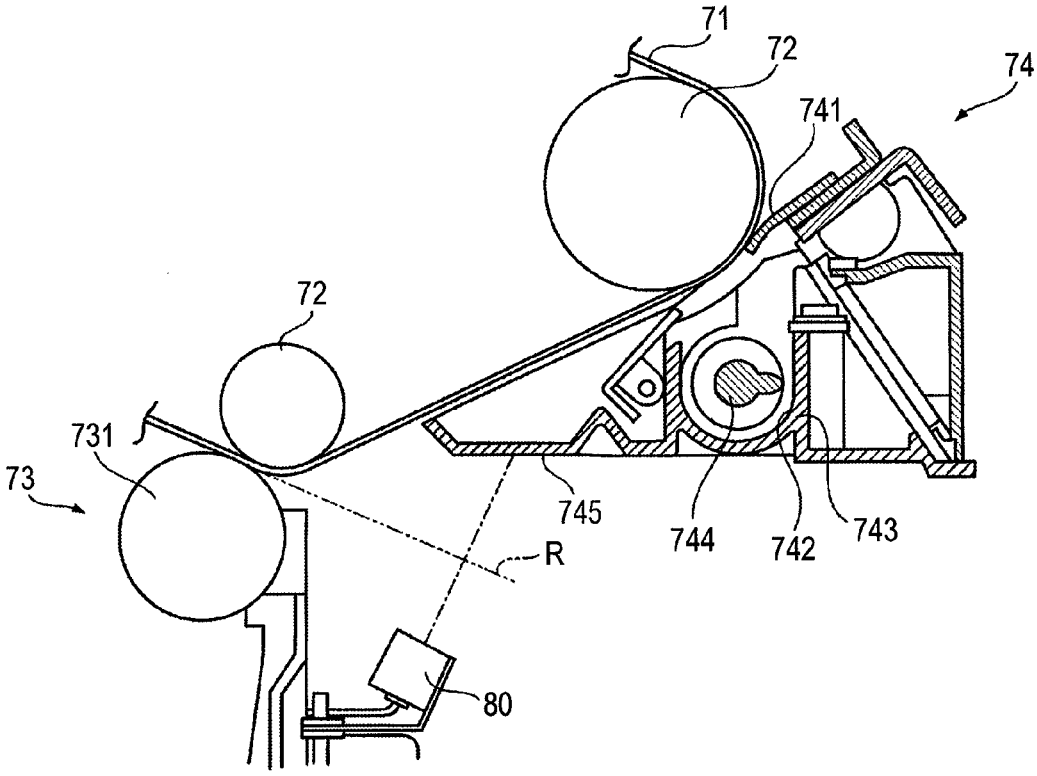
FIG. 3 is a partial enlarged view of the transfer unit and the cleaner.

FIG. 2 is a schematic view showing the intermediate transfer belt, and the transfer unit and the cleaner that are disposed around the intermediate transfer belt. FIG. 3 is a partial enlarged view of the transfer unit and the cleaner.

For clarity, only a transfer roller 731 of the transfer unit 73 is shown in FIG. 1. However, the transfer unit 73 includes a cleaning blade 732, a lubricant 733, and a brush roller 734 in addition to the transfer roller 731. The cleaning blade 732 comes into contact with the transfer roller 731 and removes toner, paper powder, or the like adhering to the transfer roller 731. The lubricant 733 is formed of zinc stearate and is supplied to the transfer roller 731 in order to secure lubrication between the cleaning blade 732 and the transfer roller 731. The brush roller 734 supplies the lubricant 733 to the transfer roller 731.

Further, a light sensor 80 is disposed on the downstream side of the transfer unit 73 in a sheet conveying direction along a sheet conveying path R. The light sensor 80 is a sensor that detects the presence or absence of a sheet having passed through the transfer unit 73. The presence or absence of the sheet is detected by the light sensor 80, and the presence or absence of a sheet jam in the image forming apparatus 1 is detected by the measurement of a time interval where the sheet is conveyed.

Furthermore, the cleaner 74 includes a blade 741, a storage portion 742, a housing 743, a conveying member 744, and the like. The blade 741 comes into contact with the intermediate transfer belt 71 and removes toner and the like remaining on the intermediate transfer belt 71. The storage portion 742, which stores the toner removed from the intermediate transfer belt 71 by the blade 741, is formed at the housing 743. The conveying member 744 conveys the toner, which is stored in the storage portion 742, in a depth direction perpendicular to planes of FIGS. 2 and 3.

Here, light, which is used to detect a sheet, is emitted from the light sensor 80. However, if a sheet does not exist on the conveying path R, a bottom 745 of the housing 743 of the cleaner 74 is irradiated with the light. A part of the light, which irradiates the bottom 745, is reflected from the bottom 745 and returns to the light sensor 80. Here, if the bottom 745 is not contaminated, an intensity of the reflected light is low and the presence of a sheet is not falsely detected by the reflected light. However, if the image forming apparatus 1 (see FIG. 1) is used, deposits are deposited on the bottom 745 of the housing 743 of the cleaner 74. The deposit is a mixture of toner, paper powder, a lubricant supplied to the transfer roller 731, and the like. If the deposits are deposited on the bottom 745, reflectance of a portion where deposits are deposited or a light scattering property at the portion where deposits are deposited is changed. Accordingly, there is an increase in the intensity of the light that is emitted from the light sensor 80, is reflected from the bottom 745, and returns to the light sensor 80. For this reason, the light sensor 80 employs the configuration to be described below to remove a concern that the presence of a sheet P is falsely detected by the reflected light even though the intensity of the reflected light has increased.

Figure 4A:
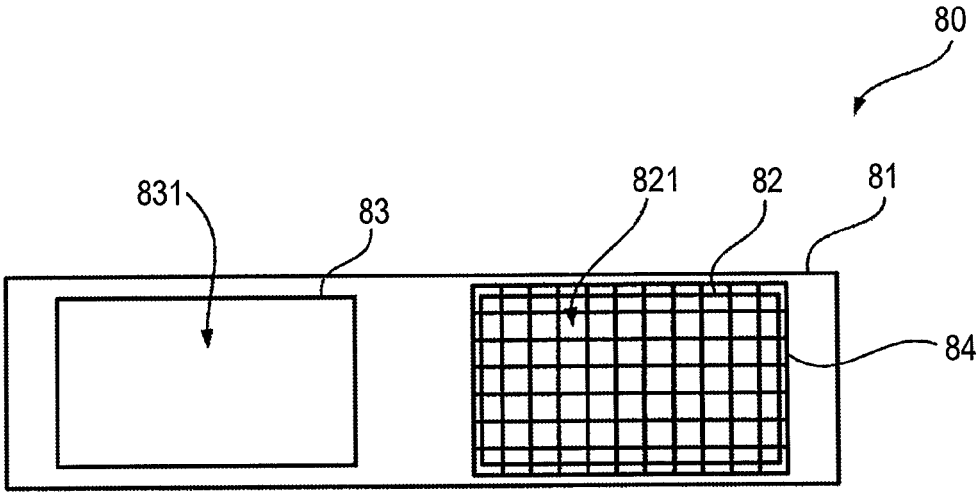
FIGS. 4A and 4B are views showing a light sensor.
Figure 4B:
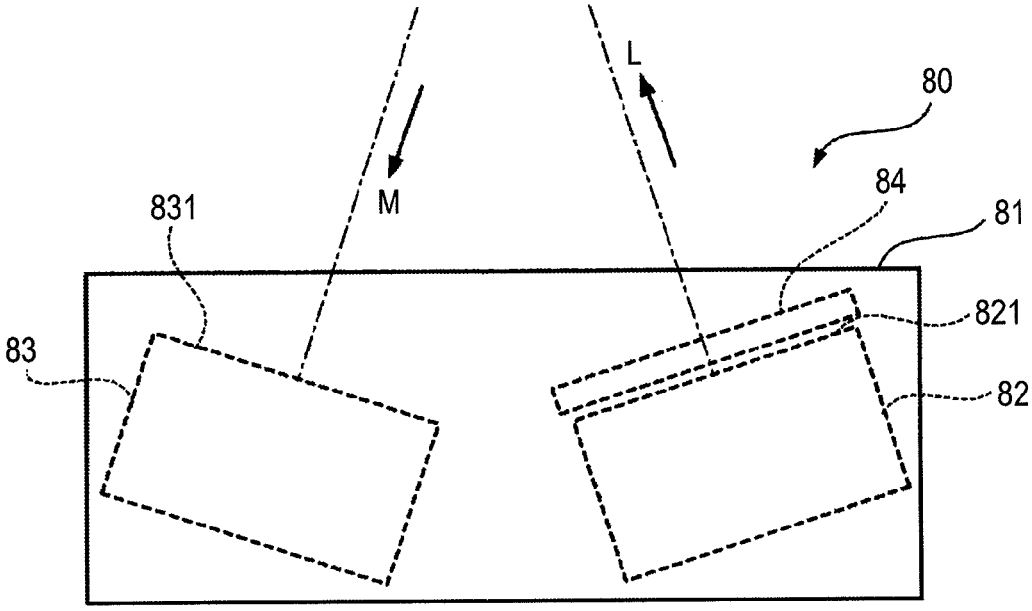

FIGS. 4A and 4B are views showing the light sensor. FIG. 4A is a plan view of the light sensor as seen from a light projecting/receiving surface, and FIG. 4B is a side view of the light sensor.

The light sensor 80 includes a light emitting part 82, a light receiving part 83, and a mesh 84 that are provided in a case 81. The mesh 84 is disposed on the front side of a light emitting surface 821 of the light emitting part 82.

In the image forming apparatus 1 according to this exemplary embodiment, the light sensor 80 is disposed so that the light emitting part 82 and the light receiving part 83 are lined up in the direction perpendicular to the planes of FIGS. 2 and 3.

The light emitting part 82 is disposed so that the light emitting surface 821 of the light emitting part 82 is slightly inclined toward the light receiving part 83. The light emitting part 82 generates light, and emits light in the direction of an arrow L where the light emitting surface 821 is directed.

However, light is not emitted from the light emitting part 82 only in the direction of the arrow L, and is emitted with a very large emission angle about the direction of the arrow L as a center.

Further, the light receiving part 83 is disposed so that a light receiving surface 831 of the light receiving part 83 is slightly inclined toward the light emitting part 82. The light receiving part 83 detects the intensity of the light that enters the light receiving part 83 in the direction of an arrow M.

However, the light receiving part 83 detects not only the light that enters the light receiving part in the direction of the arrow M but also the light that enters the light receiving part with an angle equal to or smaller than a very large emission angle about the direction of the arrow M as a center.

Figure 5A:
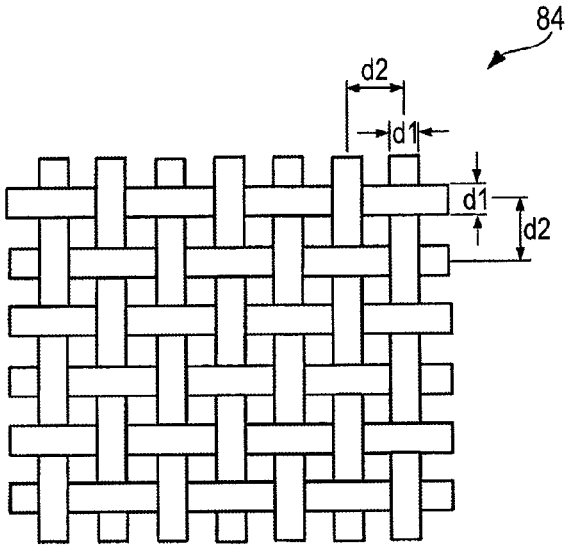
FIGS. 5A to 5C are views showing respective examples of a mesh that is disposed on the front side of a light emitting part.
Figure 5B:
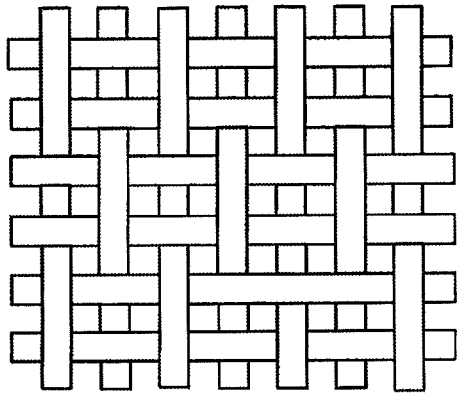
Figure 5C:
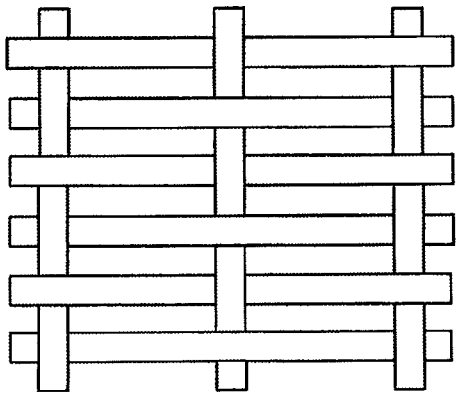

FIGS. 5A to 5C are views showing respective examples of the mesh that is disposed on the front side of the light emitting part.

In this exemplary embodiment, for example, the mesh 84 having a shape shown in FIG. 5A is disposed on the front side of the light emitting part of the light sensor 80 shown in FIGS. 4A and 4B.

The mesh shown in FIG. 5A is a mesh that is formed by plain-weaving fluororesin fibers having a diameter d1 of 100 μm at a pitch d2 of 200 μm in the vertical and horizontal directions.

As shown in FIGS. 4A and 4B, the mesh 84 shown in FIG. 5A is disposed on the front side of the light emitting surface 821 of the light emitting part 82. For this reason, the light, which is emitted from the light emitting part 82 and passes through the mesh 84, is changed into emitted light having a small emission angle that is limited according to the pitch d2 of the fibers.

The inclination of the light emitting part 82 and the light receiving part 83 is adjusted so that the light emitting part 82 and the light receiving part 83 are aimed at the same portion of a sheet passing along the sheet conveying path R. For this reason, if an emission angle is limited, the light emitting part 82 and the light receiving part 83 are aimed at different potions on the bottom 745 of the housing 743, which are disposed at positions more distant than the sheet conveying path R as seen from the light sensor 80. Further, since the emission angle is limited, the intensity of the scattered and reflected light directed to the light receiving part 83 is also low. Accordingly, the false detection of the presence of a sheet on the sheet conveying path R, which is performed by the light reflected from the bottom 745, is prevented.

Here, when the emission angle of the light emitted from the light emitting part 82 is limited, it is considered that not the mesh 84 but a plate-like or sheet-like optical filter, which is optically designed, is disposed. According to the optical filter, it may be possible to obtain a filter that has been adjusted with high accuracy in terms of a desired property. However, since the image forming apparatus 1 may be used in an environment which remarkably changes from high temperature and high humidity to low temperature and low humidity, condensation occurs in the case of the plate-like or sheet-like optical filter in the environment that changes remarkably as described above. For this reason, there are concerns that the optical filter will not function, as well as will ruin the function of the light sensor.

Since the above-mentioned mesh 84 has been employed instead of the optical filter in this exemplary embodiment, the mesh effectively operates to limit the emission angle even in the environment that changes remarkably. As a result, false detection is prevented.

Meanwhile, the fibers having the diameter d1 of 100 μm and the pitch d2 of 200 μm have been described with reference to FIG. 5A in this exemplary embodiment, but are not limited thereto. Even though fibers having the diameter d1 of, for example, 100 μm are used and the pitch d2 of the fibers is changed in a range of 150 to 300 μm under the circumstances shown in FIGS. 2 and 3, false detection is reliably prevented.

The diameter d1 of the fiber is also not limited to 100 μm, and is appropriately selected according to the use environment and the like of the mesh. Further, the fiber is also not limited to a fluororesin fiber, and the material of the fiber may be selected appropriately.

Furthermore, FIGS. 5B and 5C are views showing meshes of which weaving methods are different from a method of weaving the mesh shown in FIG. 5A.

FIG. 5B is a view showing a twilled woven mesh, and FIG. 5C is a view showing a mesh of which the pitch of arranged warps is larger than that of wefts.

The twilled woven mesh shown in FIG. 5B also has substantially the same filter performances as those of the plain woven mesh shown in FIG. 5A.

In the case of FIG. 5C, the emission angle is limited in the vertical direction in the drawing and the emission angle is not limited substantially in the horizontal direction since gaps between the fibers are excessively large. However, even when an emission angle is limited only in the vertical direction in the drawing, a function of preventing false detection is fulfilled. In particular, in the case of this exemplary embodiment, it may be possible to obtain a large margin in terms of false detection by disposing the mesh so that a direction connecting the light emitting part 82 with the light receiving part 83 shown in FIGS. 4A and 4B corresponds to a direction (the vertical direction in FIG. 5C) where the fibers are closely arranged.

Further, the meshes are shown in FIGS. 5A to 5C. However, the warps of FIG. 5C may be removed and only the wefts may be arranged so that these wefts are supported on both sides.

Furthermore, the mesh 84 has been disposed on the front side of the light emitting part 82 in FIGS. 4A and 4B. However, the mesh 84 may be disposed on the front side not of the light emitting part 82 but the light receiving part 83 so that the spread (light receiving angle) of light entering the light receiving part 83 is limited. Alternatively, meshes may be disposed on both the front side of the light emitting part 82 and the front side of the light receiving part 83 so that both the emission angle and the light receiving angle are limited.

Moreover, in the image forming apparatus 1 according to this exemplary embodiment, the light sensor 80 has been disposed in the image forming section 20 on the downstream side of the transfer unit 73, which transfers a toner image to a sheet, in the sheet conveying direction and near the sheet conveying path on the upstream side of the fixer 90. However, the position of the light sensor 80 is not limited to this position, and the light sensor may be applied to detect a sheet passing through any position on the sheet conveying path, and is helpful in preventing false detection under the environment where a member, which may generate reflected light, exists other than a sheet.

In addition, the invention is not limited to an image forming apparatus, and may be widely applied to a conveying device that conveys a body to be conveyed and needs to detect the body to be conveyed.

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention should be defined by the following claims and their equivalents.

What is claimed is:

1. A conveying device comprising:

a conveying member that conveys a body to be conveyed;

a sensor that is disposed at a position adjacent to a conveying path of the body to be conveyed and detects the body to be conveyed; and a cleaner housing that is disposed on a downstream side of the sensor, wherein the sensor includes:

a light emitting part that emits light, a light receiving part that receives reflected light, which is emitted from the light emitting part, is reflected, and returns, and a plurality of fiber bodies that are disposed on a front side of at least one of the light emitting part and the light receiving part and operate as a filter limiting an emission angle or a light receiving angle, wherein the plurality of fiber bodies are woven into a mesh, wherein the light emitting part is configured to incline at a first inclination angle and the light receiving part is configured to incline at a second inclination angle such that the light emitting part and the light receiving part are aimed at different portions of the cleaner housing, and wherein the first inclination angle and the second inclination angle are different inclination angles.

2. The conveying device according to claim 1, wherein the plurality of fiber bodies are arranged in two directions crossing each other and limit the emission angle or the light receiving angle in the two directions.

3. The conveying device according to claim 1, wherein the sensor is configured to detect presence and absence of a recording medium.

4. The conveying device according to claim 1, wherein the plurality of fiber bodies comprise a mesh of woven fluororesin fibers, and wherein the fluororesin fibers have a diameter of 100 μm.

5. The conveying device according to claim 1, wherein the plurality of fiber bodies comprise a mesh of woven fluororesin fibers, and wherein the fluororesin fibers have a pitch from 150 μm to 300 μm in vertical and horizontal directions.

6. The conveying device according to claim 1, wherein the inclination of the light emitting part and the inclination of the light receiving part are configured so that the light emitting part and the light receiving part are aimed at a same portion of a recording medium, if the sensor detects a presence of the recording medium.

7. The conveying device according to claim 6, wherein the different portions of the cleaner housing are disposed at positions more distant from the sensor than a conveying path of the recording medium.

8. The conveying device according to claim 1, wherein the plurality of fiber bodies comprises first fiber bodies and second fiber bodies which are woven into the mesh, wherein the first fiber bodies are arranged in a first direction and have a first pitch, wherein the second fiber bodies are arranged in a second direction and have a second pitch larger than the first pitch, wherein a direction connecting the light emitting part and the light receiving part corresponds to the first direction, wherein the first direction is a horizontal direction, and wherein the second direction is a vertical direction.

9. An image forming apparatus comprising:

an image forming section that forms an image on a recording medium;

a conveying member that conveys the recording medium to the image forming section and further conveys the recording medium on which the image is formed in the image forming section;

a sensor that is disposed at a position adjacent to a conveying path of the recording medium and detects the recording medium; and a cleaner housing that is disposed on a downstream side of the sensor, wherein the sensor includes:

a light emitting part that emits light, a light receiving part that receives reflected light, which is emitted from the light emitting part, is reflected, and returns, and a plurality of fiber bodies that are disposed on a front side of at least one of the light emitting part and the light receiving part and operate as a filter limiting an emission angle or a light receiving angle, wherein the plurality of fiber bodies are woven into a mesh, wherein the light emitting part is configured to incline at a first inclination angle and the light receiving part is configured to incline at a second inclination angle such that the light emitting part and the light receiving part are aimed at different portions of the cleaner housing, and wherein the first inclination angle and the second inclination angle are different inclination angles.

10. The image forming apparatus according to claim 9, wherein the image forming section includes:

a toner image forming section that forms a toner image and transfers the toner image to the recording medium, and a fixing section that fixes the toner image to the recording medium to which the toner image is transferred by the toner image forming section, wherein the conveying member conveys the recording medium on the conveying path along which the recording medium is conveyed to the toner image forming section and is further conveyed to the fixing section, and wherein the sensor is disposed at a position adjacent to the conveying path between the toner image forming section and the fixing section.

11. The image forming apparatus according to claim 9, wherein the plurality of fiber bodies are arranged in two directions crossing each other and limit the emission angle or the light receiving angle in the two directions.

12. The image forming apparatus according to claim 9, wherein the sensor is configured to detect presence and absence of a recording medium.

13. The image forming apparatus according to claim 9, wherein the plurality of fiber bodies comprise a mesh of woven fluororesin fibers, and wherein the fluororesin fibers have a diameter of 100 μm.

14. The image forming apparatus according to claim 9, wherein the plurality of fiber bodies comprise a mesh of woven fluororesin fibers, and wherein the fluororesin fibers have a pitch from 150 μm to 300 μm in vertical and horizontal directions.

15. The image forming apparatus according to claim 9, wherein the inclination of the light emitting part and the inclination of the light receiving part are configured so that the light emitting part and the light receiving part are aimed at a same portion of a recording medium, if the sensor detects a presence of the recording medium.

16. The image forming apparatus according to claim 15, wherein the different portions of the cleaner housing are disposed at positions more distant from the sensor than a conveying path of the recording medium.

17. The image forming apparatus according to claim 9, wherein the plurality of fiber bodies comprises first fiber bodies and second fiber bodies which are woven into the mesh, wherein the first fiber bodies are arranged in a first direction and have a first pitch, wherein the second fiber bodies are arranged in a second direction and have a second pitch larger than the first pitch, wherein a direction connecting the light emitting part and the light receiving part corresponds to the first direction, wherein the first direction is a horizontal direction, and wherein the second direction is a vertical direction.

* * * * *